US012806673B2

(12) United States Patent
Gala Losada et al.

(10) Patent No.: US 12,806,673 B2
(45) Date of Patent: Nov. 24, 2026

(54) EXTRUSION PRESS

(71) Applicant: SMS group GmbH, Duesseldorf (DE)

(72) Inventors: Valentin Gala Losada, Moenchengladbach (DE); Markus Schaprian, Duesseldorf (DE)

(73) Assignee: SMS group GmbH, Duesseldorf (DE)

( * ) Notice: Subject to any disclaimer, the term of this patent is extended or adjusted under 35 U.S.C. 154(b) by 383 days.

(21) Appl. No.: 18/388,917

(22) Filed: Nov. 13, 2023

(65) Prior Publication Data

US 2024/0157422 A1 May 16, 2024

(30) Foreign Application Priority Data

Nov. 14, 2022 (DE) ..... 10 2022 129 991.0
Mar. 9, 2023 (DE) ..... 10 2023 105 916.5

(51) Int. Cl.
*B21C 23/21* (2006.01)

(52) U.S. Cl.
CPC ..... *B21C 23/211* (2013.01); *B21C 23/212* (2013.01)

(58) Field of Classification Search
CPC ..... B21C 23/21; B21C 23/211; B21C 23/212; B30B 11/241
See application file for complete search history.

(56) References Cited

U.S. PATENT DOCUMENTS

| | | | | |
|---|---|---|---|---|
| 3,919,878 | A | 11/1975 | Groos | |
| 2012/0244239 | A1 | 9/2012 | Yamamoto | |
| 2017/0297068 | A1* | 10/2017 | Yamamoto | B21C 23/21 |

FOREIGN PATENT DOCUMENTS

| | | | |
|---|---|---|---|
| DE | 23 31 318 | A1 | 1/1975 |
| DE | 10 2014 209 685 | B3 | 10/2015 |
| DE | 10 2015 116 002 | B4 | 8/2019 |
| EP | 3 470 146 | A1 | 4/2019 |
| EP | 3 470 146 | B1 | 8/2020 |
| ES | 426537 | A1 | 7/1976 |
| ES | 2 832 876 | T3 | 6/2021 |
| JP | 61-43142 | B1 | 6/2017 |
| JP | 2018-023988 | A | 2/2018 |
| JP | 2019-150844 | A | 9/2019 |

OTHER PUBLICATIONS

Search Report of Spanish Application No. 202330929, Dated Nov. 15, 2024 (With English Translation of relevant parts).

* cited by examiner

*Primary Examiner* — Debra M Sullivan
(74) *Attorney, Agent, or Firm* — Collard & Roe, P.C.

(57) ABSTRACT

An extrusion press for extrusion of a material to be pressed through a die has a recipient that holds the material to be pressed, and a module that can be displaced relative to the die. The module can be acted on, during extrusion, by an electric motor drive, with the force required for extrusion. The electric motor drive is connected to the module that is displaceable relative to the die, by a bearing unit that has play perpendicular to the force; and/or during extrusion, drives contraction devices for contraction of a region of a tension element that stands under tension, which element counters the force required for extrusion by tension, and/or is a linear drive, which displaces a module that is fixed in place relative to the die during extrusion and the module that is displaceable relative to the die during extrusion, relative to one another, during extrusion.

5 Claims, 7 Drawing Sheets

EXTRUSION PRESS

CROSS REFERENCE TO RELATED APPLICATIONS

Applicant claims priority under 35 U.S.C. § 119 of German Application No. 10 2022 129 991.0 filed on Nov. 14, 2022 and German Application No. 10 2023 105 916.5 filed on Mar. 9, 2023, the disclosures of which are incorporated by reference.

BACKGROUND OF THE INVENTION

1. Field of the Invention

The invention relates to an extrusion press for pressing a material to be pressed through a die, having a recipient that holds material to be pressed and having an extrusion punch that can be moved relative to the die (12), wherein at least one module of the extrusion press can be impacted with the force required for extrusion by an electric motor drive, while the extrusion takes place.

2. Description of the Related Art

From DE 10 2015 116 002 B4, for example, extrusion presses for pressing a material to be pressed through a die, having a recipient that holds a material to be pressed and having an extrusion punch that can be displaced relative to the die are known, in which the pressing forces are applied by way of hydraulic drives. Such arrangements have sufficiently proven themselves, in particular for the application of very great pressing forces.

From JP 61-43142 B1 and EP 3 470 146 B1, as well, extrusion presses for pressing a material to be pressed through a die, having a recipient that holds the material to be pressed, and an extrusion punch that can be displaced relative to the die are known, in which the pressing forces are applied using an electric motor. Such arrangements appear to be particularly suitable for extrusion presses in which lower pressing forces are supposed to be applied, and comprise a nut/spindle arrangement, in which an electric motor drives a nut so as to rotate, which in turn acts on a spindle attached to an extrusion punch or on some other module to which a force required for extrusion can be applied, so that in this way, conversion of the rotational movement of the electric motor to a linear movement takes place, and the pressing forces are applied, and the extrusion punch or the corresponding module is moved back and forth.

SUMMARY OF THE INVENTION

It is the task of the present invention to achieve a good extrusion result in spite of the use of an electric motor drive for making available the force required for extrusion.

The task is accomplished by means of an extrusion press having the characteristics of the invention. Further advantageous embodiments, if applicable also independent of these, are found below.

In order to achieve a good extrusion result in spite of the use of an electric motor drive for making available the force required for extrusion, the invention proceeds from the basic inventive idea of undertaking design measures that allow the most uniform and precise possible force effect of the pressing forces on the material to be pressed.

The most uniform and precise possible force effect of pressing forces on the material to be pressed, and thereby good extrusion results, can be achieved using an extrusion press for extrusion of a material to be pressed through a die, having a recipient that holds the material to be pressed, and having a module that can be displaced relative to the die, to which module a force required for extrusion can be applied by an electric motor drive during extrusion, if the extrusion press is characterized in that the electric motor drive is connected to the module that can be displaced relative to the die by means of a bearing unit that has play perpendicular to the force.

By means of the bearing unit that has play perpendicular to the force, on the one hand an equalization possibility for possible transverse forces that occur perpendicular to the force required for extrusion is created, so that in particular, the electric motor drive can work as optimally as possible with regard to its drive output. In particular, possible transverse forces that occur perpendicular to the force required for extrusion and can impair the displacement of the displaceable module can also be appropriately absorbed. On the other hand, the force that the electric motor drive applies to the displaceable module or to a locally fixed module on which the electric motor drive supports itself is impaired as little as possible by the bearing unit that has play relative to the force, so that the force required for extrusion can be applied with as little reduction as possible.

In the case of a suitable design, in this way the guide of the displaceable module can also be relieved of stress, so that possible irregularities during the extrusion process, such as unintentional jumps or oscillations, for example, can be reduced to a minimum, so as to be able to achieve a good extrusion result in this manner.

In this regard, the force required for extrusion can be represented by a vector, so that every play of the bearing unit that allows a movement perpendicular to this force can accordingly improve a uniform and precise force effect of the pressing forces on the material to be pressed, and thereby improve the extrusion result.

In this regard, it does not play any role, at first, whether the corresponding play contains purely translational aspects or also rotational aspects, in particular with an axis of rotation perpendicular to the force vector. In particular, it appears to be advantageous if both translational and rotational aspects are covered by the play, at least to a certain extent.

Ultimately, any bearing unit by means of which a force, in particular, here the force required for extrusion, can be transferred, which has play perpendicular to it, can be used as the bearing unit that has play perpendicular to the force. In particular, the bearing unit can therefore comprise a floating bearing, which allows corresponding play perpendicular to a force that can be applied to the floating bearing.

The bearing unit can comprise, in particular, a cardanic joint, which—by its nature—can transfer a force, in other words here the pressing force, along the respective axes of rotation, and allows tilting with a component perpendicular to this force. On the other hand, the bearing unit can comprise a socket that has at least one degree of freedom, preferably at least two degrees of freedom, wherein the degrees of freedom accordingly preferably have at least one component perpendicular to the force required for extrusion. In this manner, a bearing unit can be made available in a structurally simple manner, which unit has play perpendicular to the force required for extrusion.

By means of the corresponding play, on the one hand the electric motor drive, in particular, can be correspondingly relieved of stress. In particular, a corresponding play also allows possible gear mechanism connections, such as, for example, a spindle drive or the like, to be correspondingly relieved of stress from forces that occur perpendicular to the force required for extrusion.

Independent of the combinations of characteristics mentioned above, an extrusion press for extrusion of a material to be pressed through a die, having a recipient that holds the material to be pressed, and having a module that can be displaced relative to the die, which module can be impacted with a force required for extrusion by an electric motor drive, during extrusion, can be characterized in that the electric motor drive, during extrusion, drives contraction means for contraction of a region of a tension element that is subject to pull, which element counters the force required for extrusion by means of pull, in order to achieve a good extrusion result. This also represents a design measure, if suitably configured, which allows the most uniform and precise possible force effect of the pressing forces on the material to be pressed.

Thus, an extrusion press generally exerts the required pressing force between a die and a punch that is arranged on a moving crossbeam, in order to press the material to be pressed through the die. As a rule, in this regard the pressing force is applied in that the moving crossbeam is moved in the extrusion direction toward the die or vice versa.

In order to prevent radial evasion of the material to be pressed or any evasion of the material to be pressed, at all, past the die, a recipient is generally provided, which can counteract radial expansion of the material to be pressed during extrusion. Preferably, the recipient is sealed, in a suitable manner, with regard to the die or with regard to the moving crossbeam or the punch, so that the material to be pressed can counter the pressing force applied by means of the relative movement of the moving crossbeam with regard to the die only in that it exits through the die.

Accordingly, in the present connection, the term recipient is understood to mean any module that can hold the material to be pressed and can restrict radial expansion of the material to be pressed during extrusion, to a desired extent. Preferably, the recipient is sealed relative to the die and/or the punch or the moving crossbeam, so that no or only very little material to be pressed can escape from the space delimited by the moving crossbeam or punch, the recipient and the die, on other paths besides through the die.

Ultimately, there are also extrusion presses that act indirectly, wherein in the case of such extrusion presses, generally the die itself is arranged on the punch, and wherein the punch is then configured accordingly to be hollow, so as not to prevent passage of the material through the die. In the case of such an embodiment, a corresponding sealing plate on the side opposite the punch and the die, in other words on the moving crossbeam, is then sufficient, which plate merely has to guarantee sufficient sealing relative to the recipient.

In this exemplary embodiment, as well, the punch is configured in such a manner that it penetrates into the recipient on the basis of the movement of the moving crossbeam, and in this manner reduces the space that remains for the material to be pressed within the recipient during extrusion.

It is understood that mixed forms of direct presses and indirect presses are also conceivable, wherein ultimately these do not or hardly ever occur on the market.

In order to counter the pressing forces to be applied, the extrusion presses generally have a pressing frame that comprises a die crossbeam, on the one hand, and a counter-crossbeam, on the other hand, which are connected to one another by means of tie rods, so that a corresponding drive, such as the electric motor drive, for example, can support itself on the counter-crossbeam and exert the pressing forces on the moving crossbeam. In the case of such an embodiment, a corresponding force between the counter-crossbeam and the moving crossbeam is applied by means of a spindle, by means of spindles or by means of one or more shoe pistons, which ultimately leads to the desired movement of the moving crossbeam.

However, because ultimately it is not the exertion of a force on the moving crossbeam but rather its displacement in the direction of the die that appears to be responsible for the extrusion process, it is also conceivable to pull the moving crossbeam directly against the die crossbeam, and this can be done, in particular, by way of the tension rods. In the case of such an embodiment, it is possible, in particular, to contract the tension rods accordingly, using contraction means, and to apply the pressing forces or the movement of the moving crossbeam by way of this contraction process.

In the case of such an embodiment, it might be possible to do without a counter-crossbeam entirely. Depending on the concrete implementation, it can be advantageous to use the counter-crossbeam for stabilization purposes, for example, or as a bearing body for the tension rods, on a part of the tension rods to which a tension force is no longer applied. For example, the counter-crossbeam can be provided, in a conventional manner, at the end of the tension rods which end lies opposite the die crossbeam, in each instance. If, however, the contraction means are provided on the die crossbeam, for example, so that the tension rods are driven out of the die crossbeam parallel to the material to be pressed, which is exiting from the die, in precisely this movement direction, then it can be advantageous to provide the counter-crossbeam or a corresponding stabilization of these driven-out ends on the side of the die crossbeam that faces away from the recipient, so as to stabilize the tension rods that are projecting out.

While the contraction means can therefore contract a region of a tension element of the extrusion press that is subject to pull, it is not compulsory that the tension element itself is contracted accordingly by means of the contraction means. Such contraction would generally be very complicated in terms of construction, in particular since the corresponding contraction of the tension element would have to take place under pull, and renewed lengthening of the tension element would be necessary for a new extrusion process that follows a current extrusion process. Accordingly, it will generally be easier if the contraction means merely contract the region of the corresponding tension element that is subject to pull, and this can be implemented, for example, by way of cable winches, spindles or linear drives, in a structurally simple manner.

In this regard, in the present connection the term "contraction means" refers to any device that is able to contract a region of a tension element that is subject to pull. This then leads, during an extrusion process, to a contraction of the distance between the modules that are connected to one another by way of the tension element and exert the pull on the tension element. This could then be, in particular, modules that are fixed in place relative to the die or, accordingly, relative to the displaceable modules, in particular the module that is displaceable relative to the die, which has already been mentioned above.

In particular, independent of the combinations of characteristics mentioned above, an extrusion press for extrusion of material to be pressed through a die, having a recipient that holds the material to be pressed, and having a module that can be displaced relative to the die, to which a force required for extrusion can be applied, during the extrusion, by an electric motor drive, can be characterized in that the electric motor drive is a linear drive, which displaces a module that is fixed in place relative to the die during extrusion and the module that is displaceable relative to the die during extrusion relative to one another during extrusion, so as to achieve a good extrusion result. In this regard, the use of a linear drive proves to be a design measure that accordingly allows the more uniform and precise possible force effect of the pressing forces on the material to be pressed.

As has already been explained above, it appears to be relevant, during extrusion, to displace one module relative to the die, so as to exert pressing forces on the material to be pressed in this way, and to force the latter through the die.

Accordingly, in the present connection, the term of the module that can be displaced relative to the die is understood to mean any module of an extrusion press that can be displaced relative to the die. Preferably, this module is then acted on by at least part of the pressing forces, preferably all of the pressing forces. In particular, a corresponding displaceable module can be made available by a moving crossbeam. Likewise, the punch itself or a sealing plate can represent a corresponding displaceable module.

Preferably, the displaceable module is driven by way of a drive, in particular by way of the electric motor drive. In this regard, it is understood that modules of the electric motor drive are not necessarily or do not have to be included among the displaceable modules. In particular, a spindle, for example, although it is also moved, can be viewed as part of the drive or as part of a gear mechanism between the drive and the displaceable module and not as part of the displaceable module.

Ultimately, every module of the extrusion press that remains fixed in place or can remain fixed in place relative to the die during extrusion can be viewed as a locally fixed module in the present connection. In particular, for example, as a rule the die crossbeam can be defined as a locally fixed module, which is correspondingly locally fixed with reference to the die. The same holds true for the punch in the case of an indirect press. In general, the tension rods and the counter-crossbeam can also be viewed as a locally fixed module relative to the die, during extrusion, if the drive supports itself on the counter-crossbeam and acts on the moving crossbeam so as to displace it. On the other hand, it is also conceivable that the counter-crossbeam is not a locally fixed module relative to the die, if, for example, the counter-crossbeam itself is displaced during extrusion, which can be the case if the counter-crossbeam serves as a positioning element for ends of tie rods, which in turn are also moved with reference to the die, which can be the case, for example, when using the aforementioned contraction means. In the case of direct presses, the recipient will also generally remain locally fixed with reference to the die during extrusion, while a recipient in indirect presses is generally displaced along with the moving crossbeam, so that it then cannot be viewed as a locally fixed module.

In the present connection, the term "linear drive" refers to any electric motor drive that can convert electrical energy to a linear movement.

In particular, the linear drive can be a direct drive or can comprise a linear actuator, by means of which a conversion of electrical energy to a linear movement can take place in a structurally precise manner and, in particular, with the use of the least possible further gear mechanism elements or no further gear mechanism elements.

Accordingly, the electric motor drive can also be a direct drive.

Direct drives are characterized by very few gear mechanism elements and, in particular, actually by no further gear mechanism elements, so that the most direct possible conversion of the electrical forces to a linear movement or to linear forces can take place. In particular, as a rule the direct drive will still bring about a linear movement, making use of a gear mechanism or of gear mechanism elements, such as, for example, nuts, screws or spindles, and this is then preferably not necessary in the case of a linear drive.

In particular, for example, torque motors or motor spindles are possible direct drives. In particular, linear actuators or linear motors can be configured correspondingly as a direct drive, if applicable. Also, brushless direct current motors can be advantageously used accordingly as electric motor drives or as a direct drive.

In particular, the contraction means can comprise the linear drive. Accordingly, the contraction means then displace a module that is locally fixed relative to the die during extrusion, counter to a module that is displaceable relative to the die during extrusion, preferably by way of their linear drive, with contraction of the region of the tension element that is subject to pull, in each instance, or of all the modules, such as tension rods, of this element. Such an embodiment has a particularly compact construction and, in particular, makes it possible to distribute the forces to be applied by the linear drive to all the modules or tension rods of the tension elements, if all of these, for example, interact with a linear drive, as long as it is possible to compensate for any tilting moments or different velocities by way of a suitable regulation mechanism. In the case of lesser tilting moments or force differences, the bearing unit explained above, which has play, can then be used, in particular, if equalization by means of a suitable regulation mechanism does not appear to be sufficient.

The embodiment stated above is particularly advantageous if the module that is locally fixed relative to the die is connected to the module that is displaceable relative to the die, by way of the tension element, during extrusion, by way of pull, so that the contraction means or the linear drive that is included in them can become effective directly.

Ultimately, any motor drive by means of which electrical energy can be converted to mechanical energy can be used as an electric motor drive. In particular, conventional electric motors, particularly also having a gear mechanism, if applicable even having a transmission, can be used accordingly.

Preferably, the electric motor drive is a direct drive, something that was already presented above, in particular with reference to the linear drive that has already been explained above as being correspondingly advantageous. On the other hand, the advantages of a direct drive as an electric motor drive can also advantageously be used in other configurations, in which a spindle, a gear wheel, a screw or a nut are supposed to be driven to rotate, as electric motor drives, so as to be able to make these rotational movements available in the most low-maintenance or low-loss manner possible.

In particular, the electric motor drive can comprise a linear actuator, as was already explained with reference to the linear drive, and this accordingly allows low-maintenance and low-loss energy conversion of electrical energy to a linear movement or to a force that is directed in a linear manner. In this regard, it does not play any role, at first, whether the linear drive or the linear actuator engages on a module, for example a tension rod, of the tension elements or whether a separate device, such as a pressure rod or the like, for example, is driven by the related linear actuator.

Preferably, however, the linear actuator engages on a tension element, wherein it appears advantageous, in particular, if each of the tension rods of the tension element interacts with a corresponding linear actuator. In this manner, a relatively compact embodiment of the extrusion press can be implemented.

In this regard it is advantageous, in particular, if the tension element has a stator of the linear actuator. In particular, a tension rod of the tension element, for example, can be a stator of the linear actuator. In this way, the tension element that is present in any case can be subject to double use, in that is serves as a stator for the linear actuator, which then interacts, as a counter-piece, for example with a rotor that is arranged on the moving crossbeam or some other movable module, so as to implement the related linear movement, and on the other hand serves as a tension element.

The linear drive can comprise a seal, so that the risk of contamination of the linear drive is minimized. Although at first glance, extrusion presses as such should have a relatively low tendency to contaminate their surroundings, it has turned out that in particular the high temperatures of the material to be pressed and diverse ancillary aggregates, such as, for example, extrusion residue shears, can lead to the result that nevertheless a relatively high degree of contamination is found in the surroundings of an extrusion press. By means of the seal, movable modules that are involved in the application of the pressing forces, for example spindles, nuts, screws or other gear mechanism elements, but also rotors and stators of direct drives or linear drives and, in particular, linear actuators can be protected against such contamination, particularly since these modules must be considered to be extremely sensitive, vulnerable or failure-prone with regard to contamination, either due to friction or on the basis of magnetic or electrostatic effects.

These risks can be minimized by means of a seal.

Preferably, in particular by means of the seal, moving modules are sealed off toward the outside, and this can be implemented, for example, in the form of folding bellows or sealing bodies that can be displaced relative to one another, such as, for example, tubes or hollow bodies that move into one another. Also, conventional sealing rings or brush rings can be used in this regard.

It is understood that if necessary, further restriction of contamination can be provided by means of supplemental measures, such as, for example, by means of an excess pressure within the sealed-off space, by means of flushing, or by means of supplemental brushes, if this appears to be necessary.

The extrusion press can comprise a spindle and a nut that can be displaced relative to the spindle, by means of which the force required for extrusion, in particular, can be made available. In the case of such an embodiment, as well, a seal as described above can be advantageous, since the relatively great forces, the relatively large contact surface between spindle and nut, as well as the relatively great friction, which must be feared in this embodiment, make possible contaminations of the spindle or of the nut appear to be particularly relevant.

In particular, either the spindle or the nut can be driven to rotate by means of the electric motor drive, wherein the latter—as has already been explained above—can, in particular, be configured as a direct drive.

In an alternative embodiment, the spindle can comprise or represent a tension element. This then makes an extremely compact embodiment possible, because then contraction means can be made available directly, by way of the spindle and the related nut.

In particular, it then appears to be advantageous, in the case of such an embodiment, if each of the tension rods is configured accordingly, so that a related moving crossbeam can be moved or have a pressing force applied to it as uniformly as possible.

For design implementation, it is advantageous if the tension element comprises at least one tension rod. This rod can be configured in different ways, depending on the concrete implementation. Thus, for example, solid rods are known as tension rods, as are ribs arranged parallel to one another. Likewise, cables are also used.

If applicable, support elements, such as, for example, tubes that enclose cables or ribs are additionally used between the modules connected by means of the tension rods. In this regard, the tension rod, depending on its concrete implementation, can be configured in one piece or in multiple pieces. In particular, clamping elements or clamping screws or wedges or similar devices can also be components of the tension element, so as to guarantee a defined distance between the modules connected to the tension rod and a sufficient possibility of absorbing the tension forces that occur.

In this regard, it is already known that the tension element or the tension rod or rods can take on further functions within the scope of the extrusion press. For example, movable modules, such as, for example, the moving crossbeam or a recipient can be guided or actually driven on the tension rod. The same holds true for extrusion residue shears, which can be guided or actually driven on the tension element or on one or more tension rods, if necessary for displacements parallel to the pressing force direction.

In particular, the tension element can comprise, two, three or four tension rods, which are preferably arranged symmetrically relative to the pressing forces that occur. In this regard, point symmetry or mirror symmetry is possible, in particular. In this manner, the most uniform possible distribution of the pressing forces over the tension rods and thereby also over the modules subjected to stress by way of the pressing forces can be made possible.

Thus, the tension element can engage on a die crossbeam with tension during extrusion, in particular if this crossbeam represents a or the module that is fixed in place relative to the die. In particular, accordingly the tension rod or rods can engage on the die crossbeam with tension during extrusion, so that the forces that act on the die and thereby also on the die crossbeam can be passed on accordingly, with tension, by way of the tension element or by way of the tension rod or rods.

Cumulatively or alternatively, the tension element can engage on a counter-crossbeam during extrusion, with tension, and this is advantageous, in particular, if the counter-crossbeam represents a module that is fixed in place relative to the die. The same also holds true for the tension rod or rods. By means of such an embodiment, the possibility then exists that the counter-crossbeam absorbs forces that are directed counter to the pressing forces, and can then balance them out by way of the tension elements.

In particular if the tension element works together with contraction means, it can be advantageous if the tension element engages on the moving crossbeam with tension, as a or the module that can be displaced relative to the die during extrusion, with tension. In this way, the moving crossbeam can be pulled against the die or against the die crossbeam, and thereby, accordingly, pressing forces against the die can be applied by way of the moving crossbeam. Such an embodiment proves to be particularly compact.

As has already been indicated above, the module to which force is applied can be guided over at least one moving crossbeam, and this is the case, for example for a punch of a direct press or for a press-down plate or an indirect press.

In general, the moving crossbeam is guided on the extrusion press in a suitable manner, particularly because it is supposed to perform a moving function as a crossbeam. Guide rails, in particular, can serve for this purpose. Frequently, modules of the tension element, such as tension rods or spacers, for example, such as tubes that maintain spacing, serve as such guides, along which the moving crossbeam can then run. It is understood that in deviating embodiments, separate guides can also be provided. These guides can also serve as part of a drive for such modules, depending on the concrete implementation, for example for targeted displacement of the recipient.

In particular, the module to which force is applied can also be the moving crossbeam itself, wherein it is understood that the moving crossbeam can also be a component of the module to which force is applied, if, for example, not just the moving crossbeam but also the punch or a sealing plate are defined as components of the module to which force is applied.

In particular, the module to which force is applied and which can be displaced relative to the die, for example in the case of a direct press, can be the extrusion punch or carry the extrusion punch, as has already been indicated above. In the case of an indirect press, the module to which force is applied and which can be displaced relative to the die can also be or carry the press-down plate, for example. Likewise, as has already been explained above, the extrusion punch or the press-down plate can be a component of the module to which force is applied and which can be displaced relative to the die.

Depending on the concrete embodiment, the extrusion punch can also be configured in one piece with the module to which force is applied and which can be displaced relative to the die.

In particular, the extrusion press can be a metal extrusion press, with which a metallic block can be pressed through the die. For example, metallic wires, rods, tubes and/or other prismatic profiles can be produced using an extrusion press.

In this regard, in the present connection an "extrusion press" is understood to be a press that can serve for primary forming or forming methods.

Such extrusion presses, in particular metal extrusion presses, can work not only with blocks, for example metallic blocks, but also with powder-type materials, for example with powders that comprise metallic, ceramic and/or hard substances, with graphite powders or mixtures thereof, wherein corresponding granulates can also be considered equivalent, and for this purpose, if applicable, the powders or granulates can be sufficiently compacted in advance and pressed, or suitably sheathed so as to then be able to load them into the recipient of the extrusion press.

It is conceivable that plastic materials can also be processed, wherein the method is generally referred to as extrusion in the case of pure plastic materials. Frequently an additional mechanical introduction of energy takes place when pressing plastic materials, for example by means of an extruder screw, while this is generally not found in the case of extrusion presses.

Preferably, profiles composed of stainless steel or aluminum undergo primary forming or forming using the present extrusion press, wherein it is understood that the use of the extrusion press of the present invention is not restricted to this, but rather can also be used for different products.

In this regard, the material to be pressed by an extrusion punch, a press-down plate or a similar module, with the force required for extrusion, against a die and through it. The primary forming process or forming process takes place in this manner.

In order for the material to be pressed to actually be pressed through the die and not to escape to the side, the material to be pressed is surrounded by a recipient during extrusion. Depending on the concrete implementation, the recipient generally remains fixed in place during extrusion, with reference to the extrusion punch or the die, wherein in this regard, theoretically mixed forms are also conceivable, as has already been explained above.

In this regard, in the present case the term recipient is understood to mean any module that can hold the material to be pressed and prevent it from breaking out to the side during the extrusion process. Depending on the concrete implementation, seals can also be provided for the moving crossbeam, the punch or the press-down plate or the die, so as to force the material to be pressed through the die with the least possible loss.

Accordingly, the recipient is preferably a block recipient, into which metallic blocks or powders or granulates that have been compacted, pressed or suitably sheathed to form blocks can be inserted, so as to then extrude them. As a rule, accordingly an extrusion press that is present is not filled with bulk material or material capable of flow, but rather with piece goods, namely the blocks. Depending on the concrete method management, it is understood that the blocks can be preheated in a suitable manner, so as to facilitate the subsequent extrusion process. Likewise, it is possible—depending on the concrete implementation—to heat the recipient, a sealing plate or extrusion punch separately, if the heat generated during extrusion is not sufficient to bring about sufficient flow capacity of the material to be pressed.

Since the present extrusion presses are preferably filled with blocks, or with material to be pressed that is not capable of flowing, it is advantageous if the extrusion press works discontinuously.

In a concrete process sequence, first the recipient can be filled with a material to be pressed, before extrusion, or it can be possible to fill it. During extrusion, the recipient is then emptied, or it can be emptied, and subsequently it is filled with material to be pressed once again, for a new extrusion process.

It is understood that the characteristics of the solutions described above and in the claims can also be combined, if applicable, so as to be able to implement the advantages cumulatively, accordingly.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
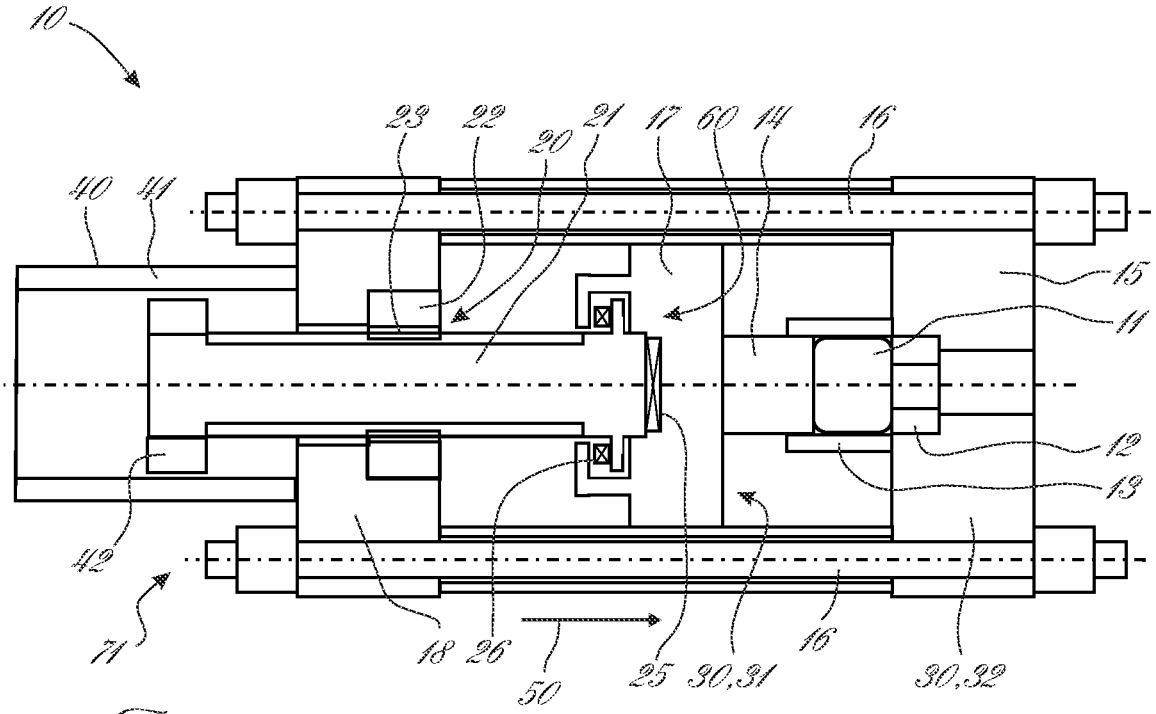
FIG. 1 shows a first extrusion press having a rotating spindle and a fixed nut, in a schematic view.

The extrusion presses 10 shown in FIGS. 1 to 4 and 10 to 12 are suitable and intended, in each instance, for pressing material 11 to be pressed through a die 12. In this way, wires, rods or other prismatic profiles having relatively complex cross-sections can be extruded from the material 11 to be pressed, which can comprise, for example, blocks that have ceramic or hard material, if applicable also composed of powders or granulates.

For extrusion, the material 11 to be pressed, in each instance, has a pressing force applied to it and is pressed through the die 12 in the extrusion direction 50.

In order for the material 11 to be pressed to be forced through the die 12, a recipient 13 is provided, into which an extrusion punch 14 can plunge, so as to apply the pressing forces.

The extrusion presses 10 shown in the drawing represent direct presses in each instance, in this regard, in which the extrusion punch 14 acts directly on the material 11 to be pressed and follows the pressing direction 50 for extrusion. Alternatively, the extrusion presses 10 can also be configured as indirect presses, in which the extrusion punch 14 carries the die 12, in each instance, and a press-down plate is displaced jointly with the recipient 13, against the die 12 and the extrusion punch 14, which accordingly leads to the result that the die 12 and the extrusion punch 14 plunge into the recipient 13, counter to the pressing direction, for extrusion.

In the present exemplary embodiments, the corresponding extrusion punch 14 is carried by a moving crossbeam 17, and these can jointly be displaced, as a module 31, with reference to the die 12. It is understood that further components, such as, for example, a connection piece 36 and a nut crossbeam 35 that migrates along (see FIG. 2) can also be included in this displaceable module 31, if applicable. In the case of an indirect press, the press-down plate as well as the moving crossbeam 17 would be combined into the module 31 that is displaceable relative to the die 12, wherein here, too, further components such as, for example, the nut crossbeam 35 and the connection piece 36, can be included, if applicable.

The die 12 is carried by a die crossbeam 15, wherein these two form a module 32 that is fixed in place relative to the die 12, and further components can still be included in this module—depending on the desired definition—which remain fixed in place relative to the die 12 during extrusion. In the case of an indirect press, the related extrusion punch 14 would also be included in the module 32 that is fixed in place relative to the die 12.

For the actual extrusion process, the two modules 31, 32 are displaced relative to one another, so that these two modules 31, 32 represent the essential effective modules 30 that must be displaced relative to one another for extrusion.

In the case of the present exemplary embodiments, the pressing forces are applied by means of an electric motor drive 40, which ultimately supports itself on the die crossbeam 15 by way of a tension element 71 or tension rod 16, with tension, so that in this manner, the pressing forces can be countered. In the case of the extrusion presses 10 shown in FIGS. 1, 2, 10, and 11, the electric motor drive 40 or a spindle/nut arrangement 20 driven by it supports itself, in each instance, on a counter-crossbeam 18, on which the tension element 71 or the tension rods 16 engage accordingly, with tension. In the case of the exemplary embodiments shown in FIGS. 3 and 12, in contrast, the counter-crossbeam 18 merely has a stabilizing function. The electric motor drive 40 or a nut 22 is provided on the moving crossbeam 17 in the case of the extrusion press 10 according to FIG. 3, so that tension forces can be transferred to the tension rods 16 by way of this nut 22. In the case of the exemplary embodiment according to FIG. 12, instead of a nut 22 that interacts with a spindle 21 carried by the tension rods 16, a rotor 75 of a linear drive 73 is arranged on the moving crossbeam 17 or configured as the latter, which rotor then can support itself on the tension rod 16, which is configured as the stator 74 of the linear drive 73, so that in the case of this exemplary embodiment, as well, the counter-crossbeam 18 merely serves for stabilization purposes.

In order to apply the pressing forces, the exemplary embodiments shown in FIGS. 1 to 3, 10 and 11 each have spindle/nut arrangements 20, which comprise a spindle 21 and a nut 22.

Figure 2:
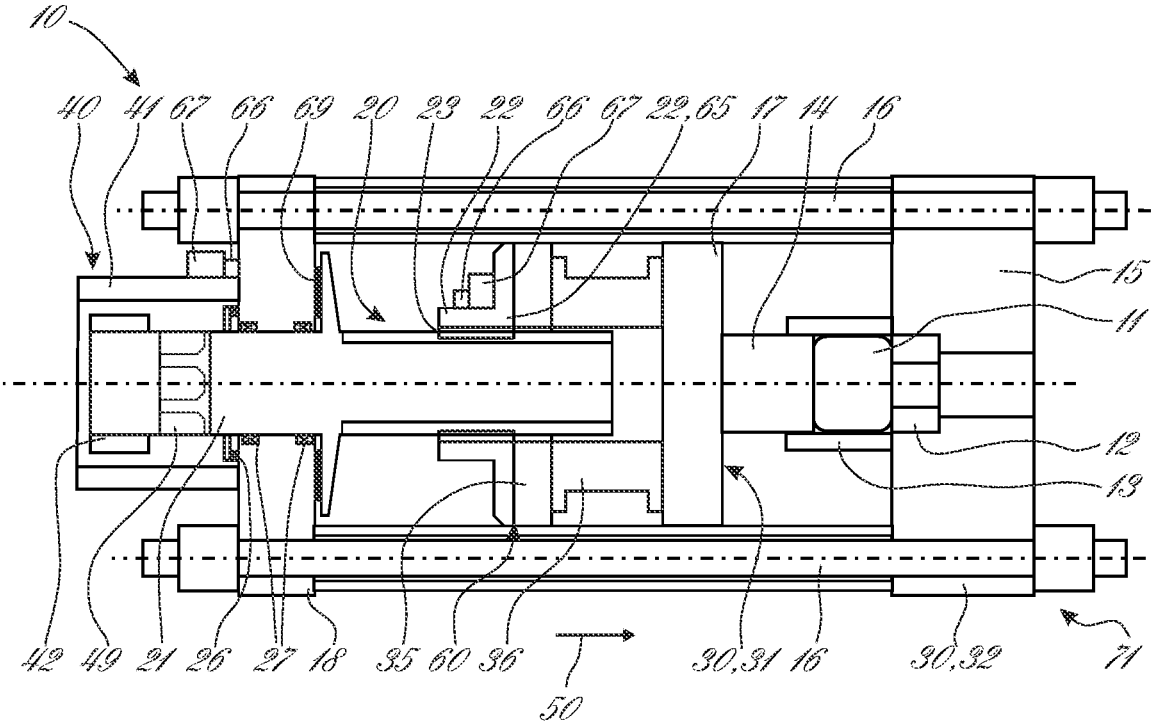
FIG. 2 shows a second extrusion press having a rotating spindle and a fixed nut, but one that migrates along, in a schematic view.
Figure 3:
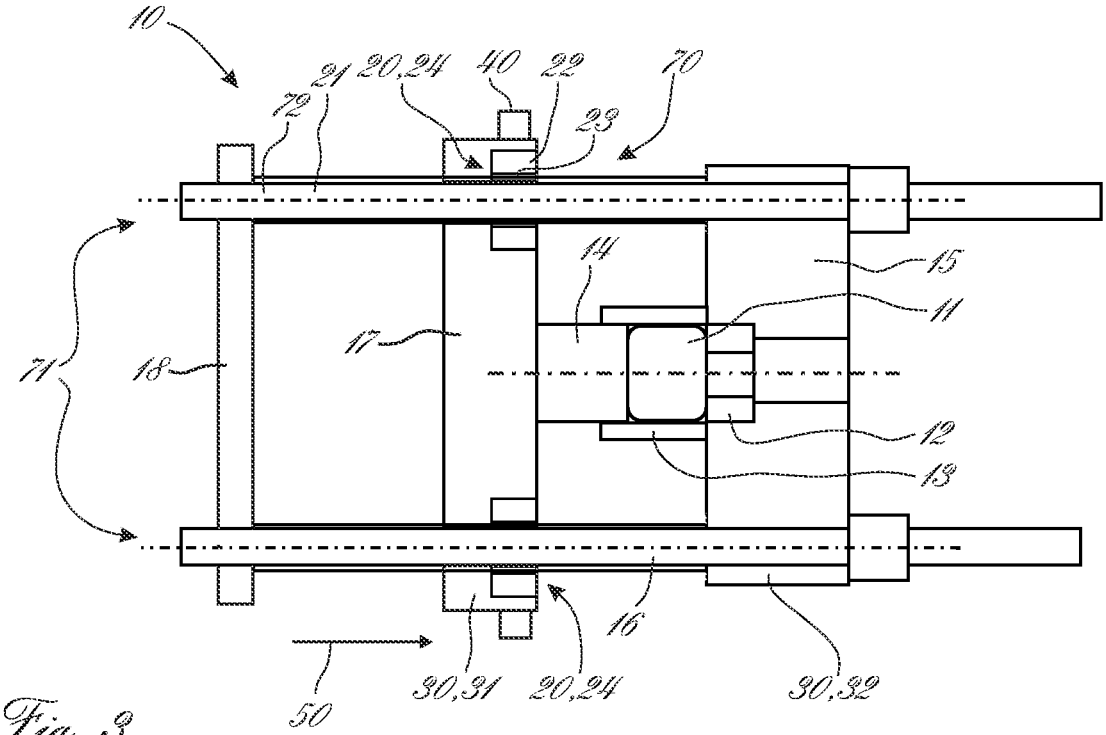
FIG. 3 shows a third extrusion press having two arrangement parts, as well as having a rotating nut and a fixed spindle, in a schematic view.
Figure 4:
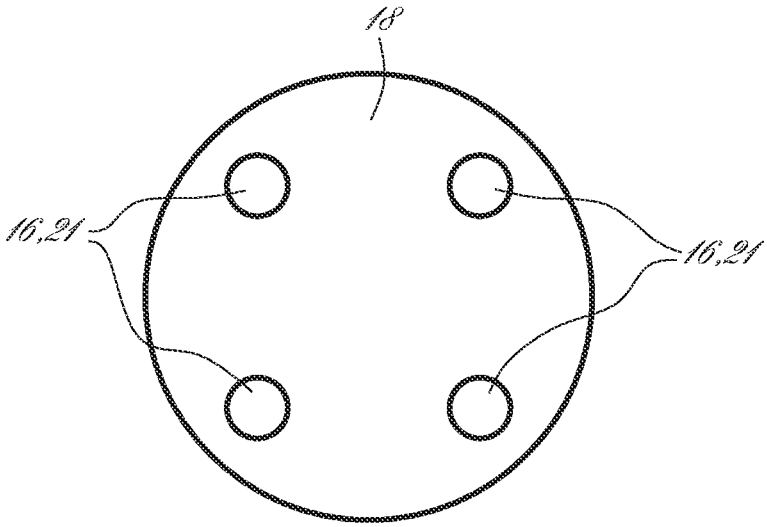
FIG. 4 shows a top view, in the pressing direction, of the extrusion press according to FIG. 3.

In this regard, in the case of the exemplary embodiment according to FIG. 3, the nut 22 is driven by the electric motor drive 40, while in the case of the exemplary embodiments according to FIGS. 1, 2, 10 and 11, the spindle 21, in each instance, is driven by the electric motor drive 40. It is understood that the corresponding types of drives can also be reversed, in that in the case of the exemplary embodiment according to FIGS. 1, 10 and 11, the nut 22 is driven to rotate, while in the case of the exemplary embodiment according to FIG. 3, a rotational drive of the spindle 21 can take place, while the nut 22 is fixed in place. Ultimately, the important thing is a relative movement between these two modules, by means of which movement the rotational movement of the electric motor drive 40 can be converted into a linear movement in the pressing direction 50 or opposite to it.

The spindle/nut arrangements 20 are configured, in the present case, as rolling screw threads 23, in order to be able to apply the greatest forces possible with little friction. Depending on the concrete embodiment, here ball screws 80 or roller screws 90 can advantageously be used, as they are explained below, using FIGS. 5 to 9. On the other hand, it is understood that in deviating embodiments, the spindle/nut arrangements 20 can also conventionally provide for a friction interaction between spindle 21 and nut 22, wherein in this regard, supplemental lubrication, for example hydrostatic lubrication, can be provided, if necessary.

A ball screw 80, as it can be used as explained above and is shown as an example in FIG. 5, comprises the spindle 21 and a nut 22 configured as a ball screw nut 82, which also comprises a ball return 83 and forms raceways 84 together with the spindle 21. Furthermore, the ball screw 80 comprises balls 81 that run in the raceways 84 and the ball return 83 during a relative rotational movement between nut 22 and spindle 21.

An electric motor drive 40 drives the spindle 21 with reference to the nut 22 or vice versa. Between the spindle 21 and the ball screw nut 82, the balls 81 move in the raceways 84, which migrate axially during rotation of the spindle 21. The movement of the balls 81 takes place as rolling off or rolling away. The ball return 83 in the ball screw nut 82 transports the balls 81 back and thereby closes the circuit in which the balls 81 circulate.

While in the case of conventional worm gears having surfaces that slide on one another, 50 to 90% of the power introduced is converted to heat, the present ball screw 80 with its ball screw drive has less friction due to the rolling movement of the balls 81. In this way, a lower drive power can be sufficient, and this is particularly advantageous when using an electric motor drive 40. Furthermore, the total wear and, in particular, the wear between spindle 21 and ball screw nut 82 is less.

It is understood that for the spindle/nut arrangement 20 of the other exemplary embodiments, and also of alternative embodiments, such ball screws 80 or also ball screws having a different structure can be used.

In an alternative embodiment, a roller screw 90 can also be used as a rolling screw thread 23 for the spindle/nut arrangement 20 or in the case of the present exemplary embodiments.

Figure 6:
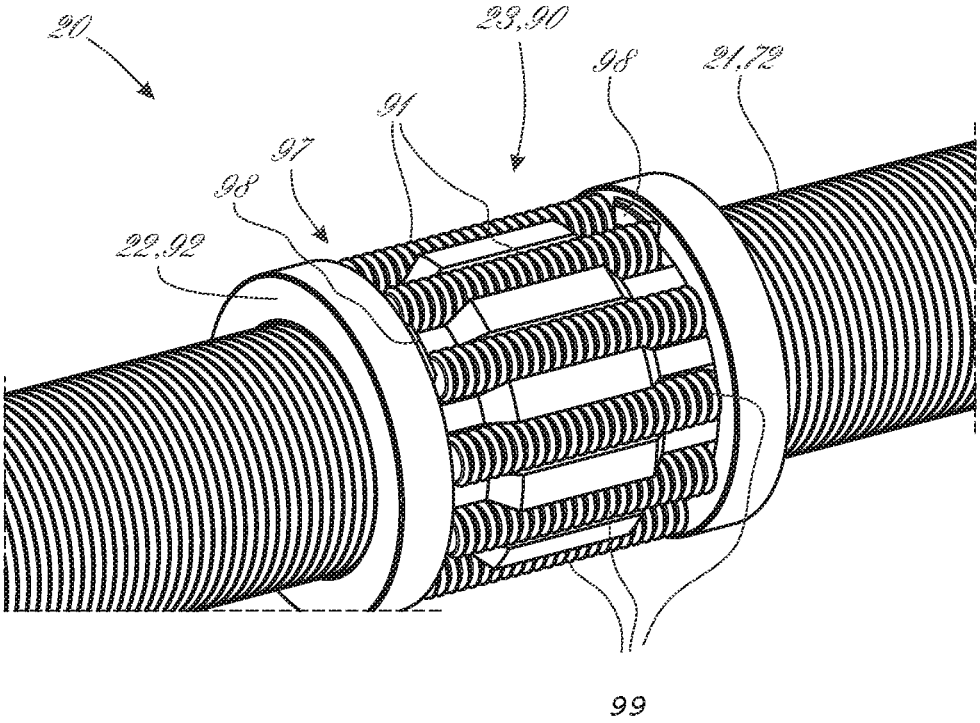
FIG. 6 shows a representation, as an example, of a roller gear drive, in a perspective view.
Figure 7:
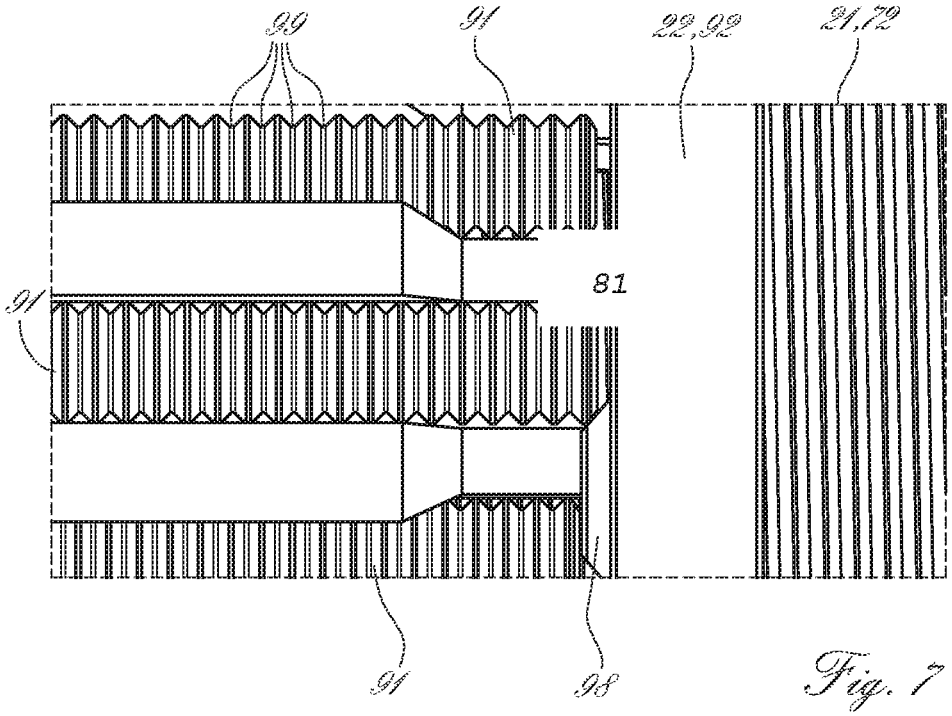
FIG. 7 shows a side view of the roller gear drive according to FIG. 6.

Such a roller screw 90 could also be configured, for example, as a roller screw drive 97, as it is shown in FIGS. 6 and 7.

In this regard, the roller screw drive 97 comprises a spindle 21 and a nut 22 configured as a recirculating roller nut 92. Rollers 91, which have circular grooves 99, in each instance, run around the spindle 21. Because the rollers 91 with their grooves 99 run around the spindle 21, a relative movement in the axial direction takes place. A correspondingly configured recirculating roller nut 92 also comprises a roller return 98. The roller return 98 serves for lifting the rollers 91 up from the spindle and setting them back in place.

Due to the radial and axial movement of the rollers 91, the recirculating roller nut 92 is configured in the manner of a cage, so as to hold the rollers 91 in position.

Figure 8:
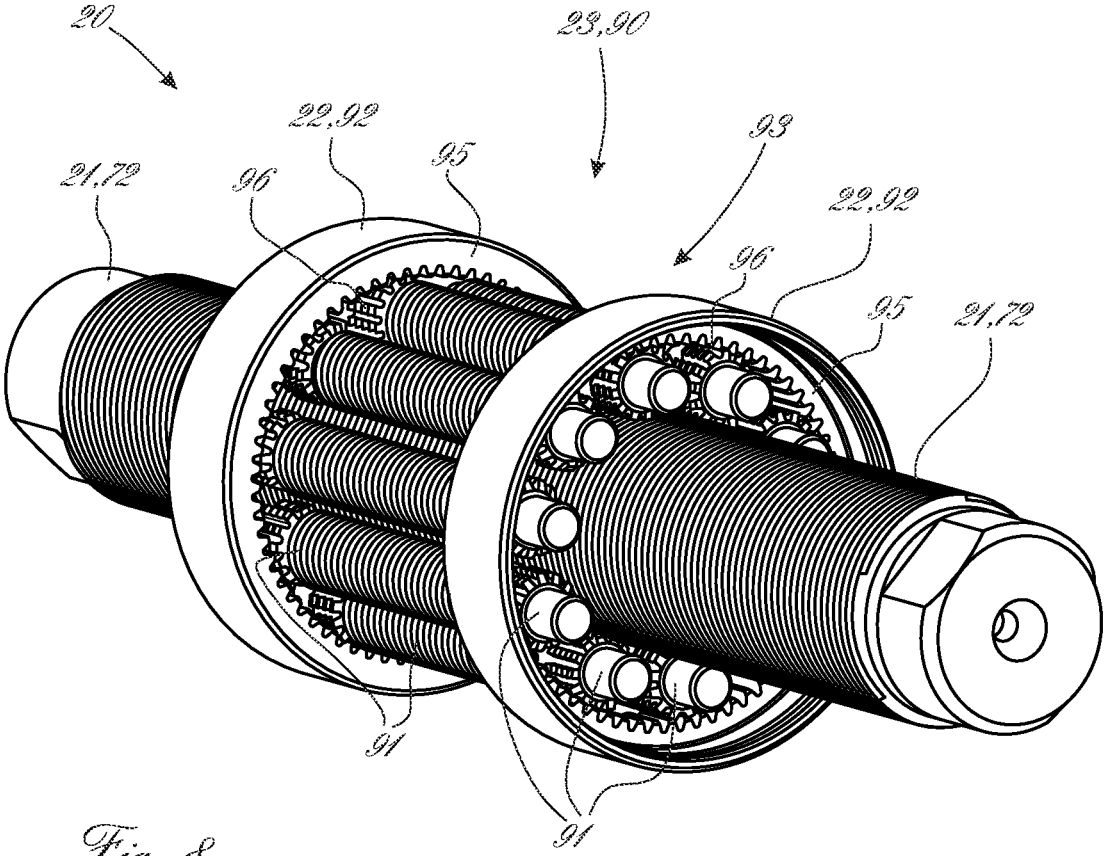
FIG. 8 shows a representation, as an example, of a planetary roller gear drive, in a perspective view.
Figure 9:
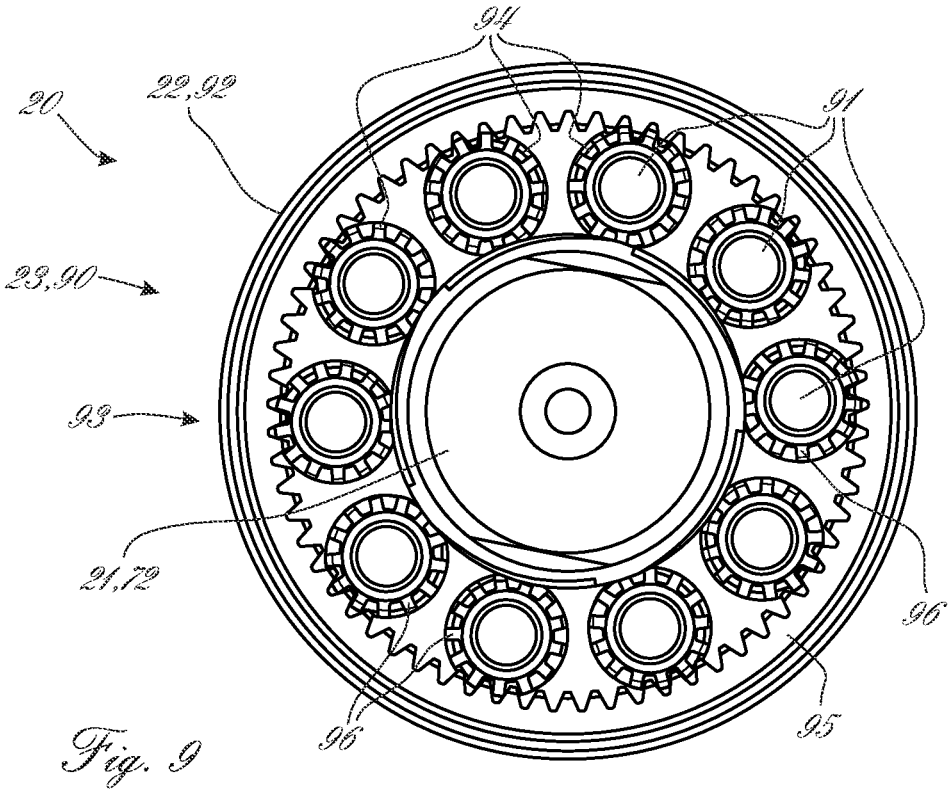
FIG. 9 shows a top view of the planetary roller gear drive according to FIG. 8.

For the extrusion presses 10 of the present exemplary embodiments, the roller screw 90 can also be configured as a planetary roller screw drive 93, as it is shown, for example, in FIGS. 8 and 9.

The planetary roller screw drive 93 comprises rollers 91 having a thread 94, which rollers rotate about a spindle 21 with its thread 94, in recirculating roller nuts 92 that are configured to be ring-shaped. By means of this rotation, an axial relative movement between 22 and spindle 21 occurs.

The diameter of the spindle 21, the rollers 91, and the recirculating roller nut 92 are selected in such a manner that the circumferential speeds of spindle 21 and rollers 91 match. The synchronization is taken on by a ring 95 integrated into the recirculating roller nut 92, which ring has an inner gearing that engages into sprockets 96 at the ends of the rollers 91.

Figure 5:
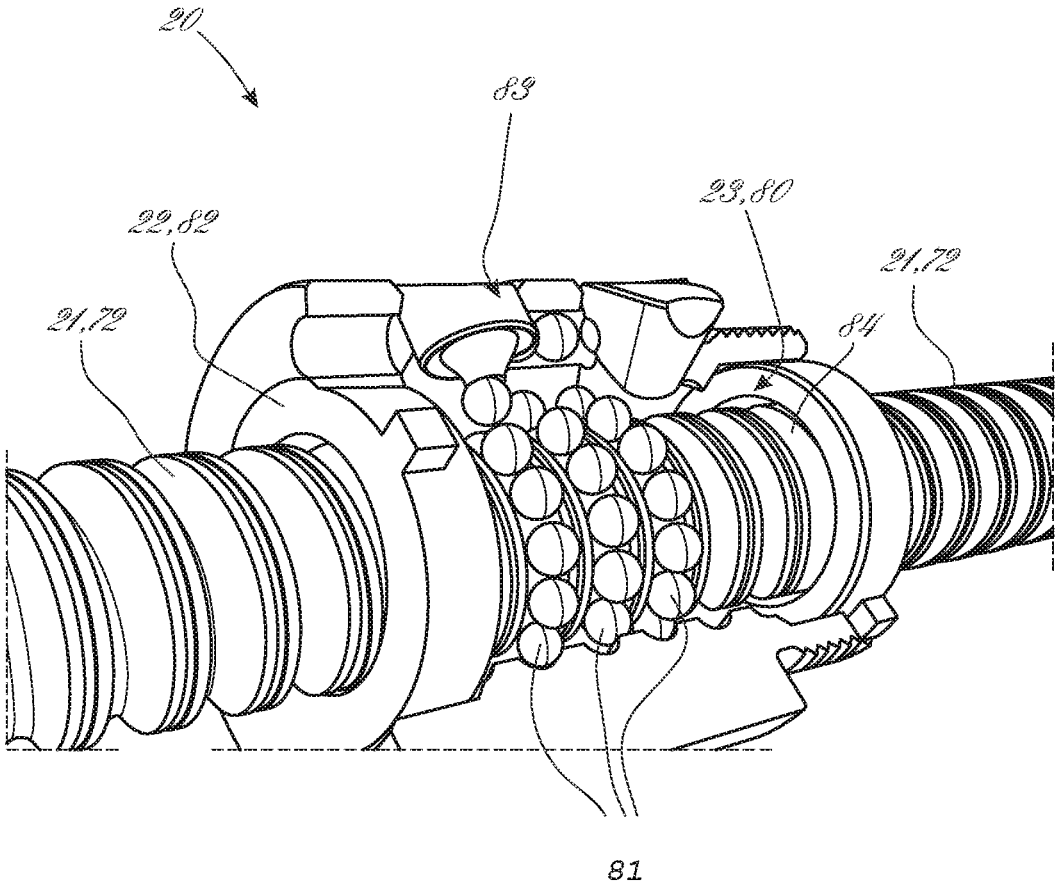
FIG. 5 shows a representation, as an example, of a ball screw, in a perspective view.

In the case of the present planetary roller screw drive 93, the rollers 91 or roller bodies—in contrast to the exemplary embodiments according to FIG. 5 as well as 6 and 7—do not move relative to the recirculating roller nut 92 in the longitudinal direction, so that no return mechanism is necessary. This can make higher speeds of rotation possible.

Roller screws 90 also allow a corresponding reduction in friction, and this incidentally also holds true for screws having hydrostatic nuts 65. Also, the combination of rolling screw threads 23 with a hydrostatic bearing or in such a manner that the nuts of the rolling screw threads 23 are then configured to be hydrostatic, can be used accordingly for a reduction in friction, wherein it is understood that these advantages are already correspondingly advantageous individually, in particular as compared with solutions known from the state of the art.

In the case of the exemplary embodiments shown in FIGS. 1, 2, 10, and 11, the electric motor drive 40 is implemented, in each instance, by means of a direct drive, which comprises a stator 41 and a rotor 42 that rotates with the corresponding spindle 21. It is understood that in deviating embodiments, other drives or types of drives can also be used, in particular, for example, transmission drives, which can actually be switched, if applicable.

Figure 10:
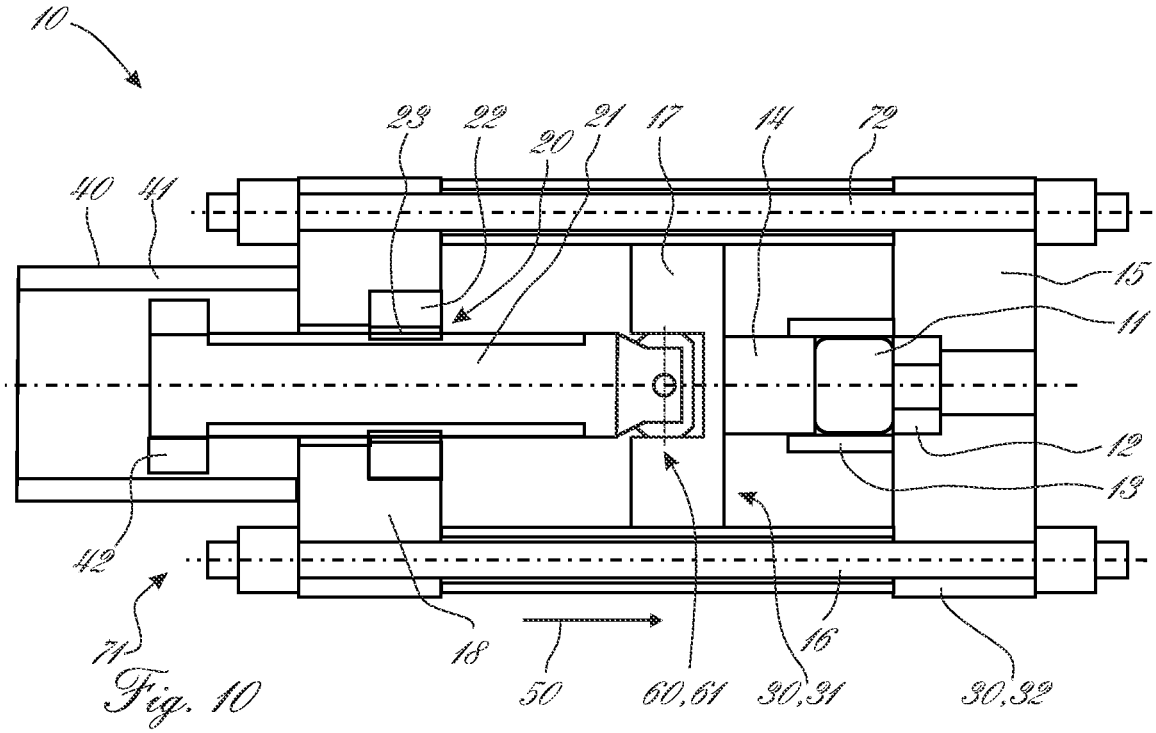
FIG. 10 shows a fourth extrusion press having a cardanic joint as the bearing unit.
Figure 11:
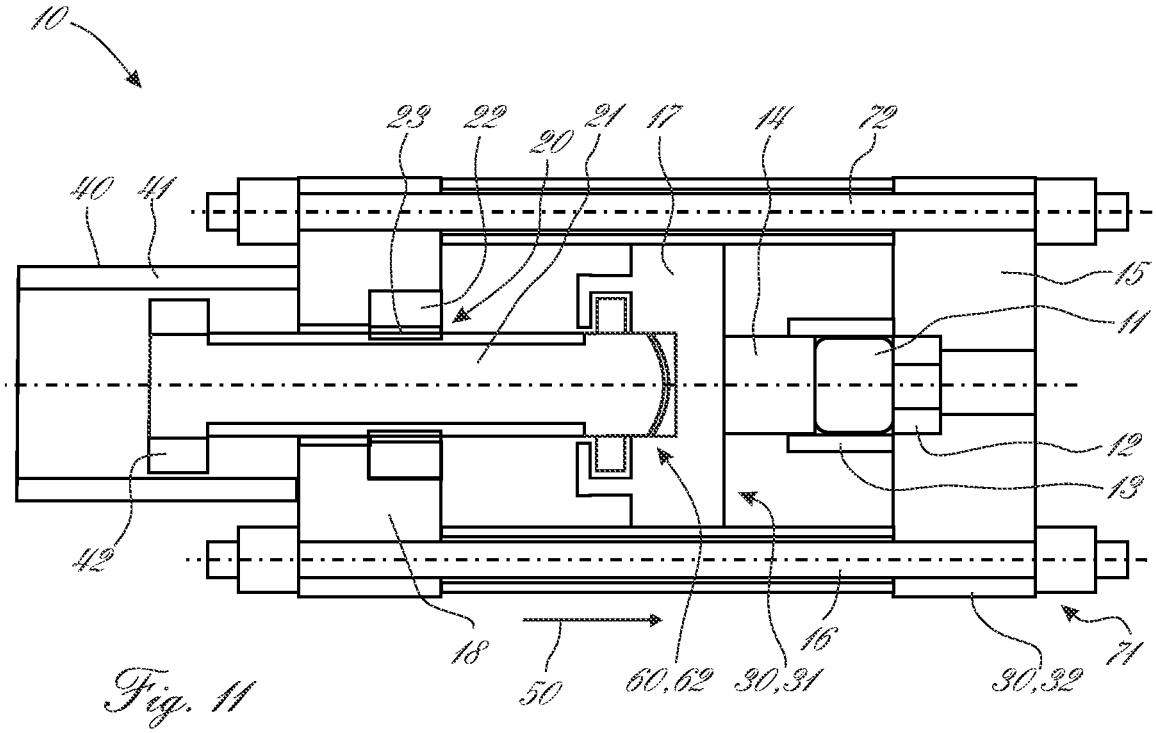
FIG. 11 shows a fifth extrusion press having a socket as the bearing unit.

Because in the case of the exemplary embodiment according to FIGS. 1, 10, and 11, the spindle 21, in each instance, is displaced together with the moving crossbeam 17, in the case of these exemplary embodiments the stator 41 is correspondingly configured to be longer than in the case of the exemplary embodiment according to FIG. 2, according to which the spindle remains fixed in place with reference to the die 12, while a corresponding hydrostatic nut 65 moves together with the moving crossbeam 17, so that the stator 41 can be configured to be correspondingly shorter.

In this regard, the hydrostatic nut 65, in the case of the exemplary embodiment according to FIG. 2, is mounted on a nut crossbeam 35, to float perpendicular to the pressing direction 50, so that in this manner, a bearing unit 60 is made available, which has play perpendicular to the pressing direction 50 and thereby perpendicular to the force required for extrusion.

It is understood that if applicable, mounting directly on the moving crossbeam 17 or direct placement of nut crossbeam 35 and moving crossbeam 17 one behind the other is possible, while in the case of this exemplary embodiment, a connection piece 36 having the function of a spacer is additionally provided between the nut crossbeam 35 and the moving crossbeam 17.

For lubrication purposes, the hydrostatic nut 65 of the exemplary embodiment according to FIG. 2 carries a bearing agent pump 66 and a bearing agent container 67, so that the hydrostatic nut 65 can be sufficiently lubricated both in its contact with the spindle 21 and in the bearing unit 60 relative to the nut crossbeam 35.

In particular, a hydrostatic nut 65 can advantageously be used both in the case of spindle/nut arrangements 20 having a rotating nut 22 and those having a non-rotating nut 22, wherein it appears to be significantly easier, in the case of a non-rotating nut 22, to make the hydraulic bearing agent available at the required locations, because it is possible to do without rotary unions or the like.

Also, the exemplary embodiment according to FIG. 2 carries a further bearing agent pump 66 having a bearing agent container 67, in the region of the electric motor drive 40, by means of which, in particular, a hydrostatic bearing 69, which can absorb forces of the spindle 21 onto the counter-crossbeam 18, which forces are directed counter to the pressing forces, can be lubricated.

It is true that the bearing agent pump 66 and the bearing agent container 67 mean additional effort for the hydrostatic bearings or lubrications, in particular an additional hydraulic effort, which effort is actually supposed to be avoided by means of the use of electric motor drives 40. On the other hand, this additional effort is not comparable to the effort and the risks when using hydrostatic drives instead of the electric motor drive 40, and is significantly less than the effort and the risks when using hydrostatic drives.

Furthermore, the exemplary embodiment shown in FIG. 2 also has a drive journal 49, which is configured on the side of the spindle 21 that faces the electric motor drive 40, and which carries the rotor 42, so that the latter is replaceable. Such an embodiment makes it possible to quickly replace the electric motor drive 40, if necessary, or to adapt it to specific requirements.

On the other hand, the spindle 21 in the case of the exemplary embodiment according to FIG. 2 is also mounted axially in the counter-crossbeam 18, by means of a return bearing 26 as well as two axial bearings 27.

It is understood that the reversal of effect, which is represented in FIG. 2, as compared with the exemplary embodiments according to FIGS. 1, 10 and 11, can also be implemented, if applicable, in the case of the latter exemplary embodiments. The same holds true for the use of the drive journal 49, so as to increase the flexibility with regard to the electric motor drive 40 that is ultimately used.

Also, the floating bearing of the hydrostatic nut 65 of the exemplary embodiment according to FIG. 2 can be used in the case of the embodiment according to FIGS. 1, 10, and 11, wherein these, however, implement alternatives in this regard, which in turn can also be used in the case of the exemplary embodiment according to FIG. 2.

Thus, the extrusion press 10 according to FIG. 1 uses mounting of the spindle 21 on the moving crossbeam 17 by means of an axially acting roller bearing 25 as well as by means of an axially acting return bearing 26, so that in this way, as well, a bearing unit 60 is made available, which allows play perpendicular to the pressing direction 50 or perpendicular to the force applied for extrusion.

The exemplary embodiment according to FIG. 10 uses a cardanic joint 61 at this location, wherein sliding mounting of this cardanic joint in response to pull and push is not shown separately in the case of this exemplary embodiment, but this cardanic joint 61 also brings about play perpendicular to the pressing direction 50 or to the force applied for extrusion. Instead of sliding mounting, roller bearings can also be used here, if applicable.

Specifically for making available play perpendicular to the pressing direction 50 or to the force required for extrusion, the arrangement according to FIG. 11 uses a socket 62 that is formed in a suitable manner, so as to allow corresponding play perpendicular to the force applied for extrusion or to the pressing direction 50 in this manner. In the case of this exemplary embodiment, the return stroke is also implemented by means of a slide bearing (not numbered), wherein instead of the slide bearings, roller bearings can also be used. Also, it is understood that these solution approaches can also be implemented, in a suitable manner, in the case of the other exemplary embodiments.

Figure 12:
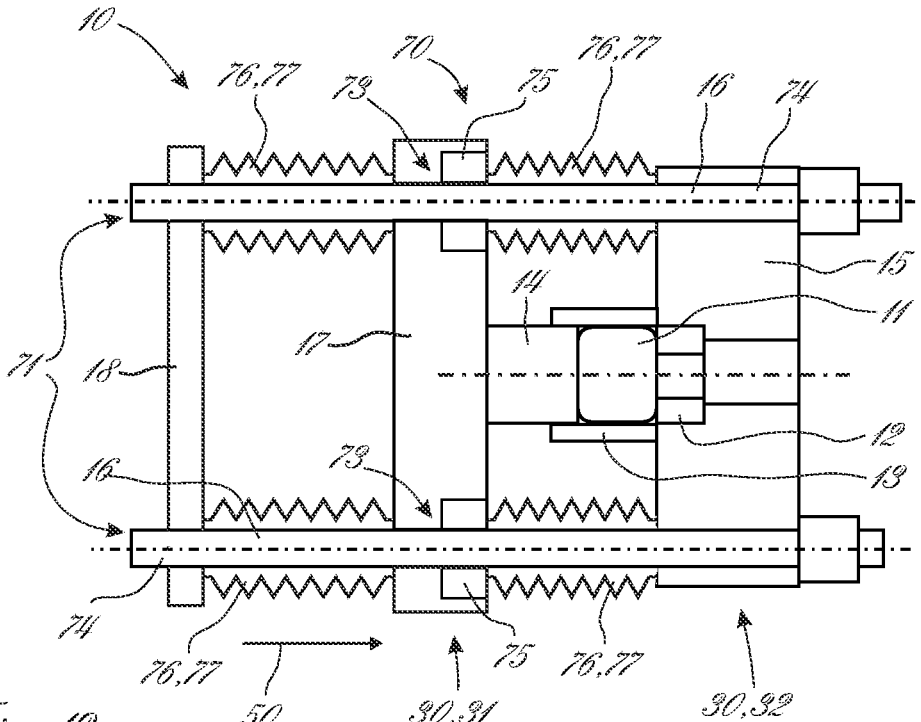
FIG. 12 shows a sixth extrusion press having contraction means that comprise a linear drive, in each instance.

In the case of the exemplary embodiments according to FIGS. 3 and 12, contraction means 70 are provided, in each instance, which contract the tension elements 71.

In this regard, in the case of these exemplary embodiments according to FIGS. 3 and 12, it is provided, in each instance, that the individual tension rods 60 are contracted, in terms of their effectiveness, in that the point at which the forces directed counter to the pressing forces are absorbed is displaced closer to the module 32 that is fixed in place relative to the die 12.

This can be done, in particular, in that the point of attack at the tension rods 16 is displaced accordingly, and this can be implemented in that the contraction means 70 correspondingly displace a nut 22 (see FIG. 3) or a rotor 75 (see FIG. 12) along the tension rods, which then can be configured as a spindle 21 (see FIG. 3) or as a stator 74 (see FIG. 12).

It is understood that in deviating embodiments, the method of effect of spindle 21 or stator 74, on the one hand, as well as nut 22 and rotor 75, on the other hand, can be interchanged, in that, for example, the spindle 21 rotates and the nut 22 is held in place. Also, for example, the tension rod 16 can be configured as the rotor of the linear drive 73 and, vice versa, a stator of the linear drive 73 can be provided on the moving crossbeam 17.

In the case of the exemplary embodiments according to FIGS. 3 and 12, the contraction means 70 or the individual drive elements of the electric motor drive 40 are provided in partial arrangements 24 corresponding to the placement of the tension rods 16. It is understood that in particular, the linear drive 73 can also be used in the case of the arrangements according to FIGS. 1, 2, 10, and 11, if applicable, wherein stator 74 and rotor 75 can be used, depending on the concrete requirements, instead of the spindle 21 or the nut 22.

In particular, the linear drive 73, as shown in FIG. 12, can be configured as a linear actuator. Specifically in the case of such an embodiment, there is the risk that due to the magnetic effects, but possibly also due to electric or electrostatic effects, contamination can occur to a greater degree. For this reason, in the case of the exemplary embodiment according to FIG. 12, a seal 76 in the form of folding bellows 77 is provided.

It is understood that in deviating embodiments, instead of a folding bellows 77, other seals can also be provided, as long as these are suitable for sealing off the critical regions.

It is also understood that in the case of the other embodiments, corresponding seals can be provided at suitable locations, if this appears to be advantageous, for example in the case of the electric motor drives 40 of the exemplary embodiments according to FIGS. 1, 2, 10, and 11, which are configured as direct drives, or in the case of the friction surfaces of the spindles 21 or nuts 22.

Although only a few embodiments of the present invention have been shown and described, it is to be understood that many changes and modifications may be made thereunto without departing from the spirit and scope of the invention.

Reference Symbol List:

| | |
|---|---|
| 10 | extrusion press |
| 11 | material to be pressed |
| 12 | die |
| 13 | recipient |
| 14 | extrusion punch |
| 15 | die crossbeam |
| 16 | tension rod |
| 17 | moving crossbeam |
| 18 | counter-crossbeam |
| 20 | spindle/nut arrangement |
| 21 | spindle |
| 22 | nut |
| 23 | rolling screw thread |
| 24 | partial arrangement |

-continued

| Reference Symbol List: | |
|---|---|
| 25 | roller bearing of the spindle 21 |
| 26 | return bearing |
| 27 | axial bearing of the spindle 21 |
| 30 | module |
| 31 | module that can be displaced relative to the die 12 |
| 32 | module fixed in place relative to the die 12 |
| 35 | nut crossbeam |
| 36 | connection piece |
| 40 | electric motor drive |
| 41 | stator |
| 42 | rotor |
| 49 | drive journal |
| 50 | pressing direction |
| 60 | bearing unit |
| 61 | cardanic joint |
| 62 | socket |
| 65 | hydrostatic nut |
| 66 | bearing agent pump |
| 67 | bearing agent container |
| 69 | hydrostatic bearing |
| 70 | contraction means |
| 71 | tension element |
| 73 | linear drive |
| 74 | stator of the linear drive 73 |
| 75 | rotor of the linear drive 73 |
| 76 | seal |
| 77 | folding bellows |
| 80 | ball screw |
| 81 | ball |
| 82 | ball screw nut |
| 83 | ball return |
| 84 | raceways |
| 90 | roller screw |
| 91 | roller |
| 92 | recirculating roller nut |

-continued

| Reference Symbol List: | |
|---|---|
| 93 | planetary roller screw drive |
| 94 | thread |
| 95 | ring |
| 96 | sprocket |
| 97 | roller screw drive |
| 98 | roller return |
| 99 | grooves |

What is claimed is:

1. An extrusion press comprising:

a die, a recipient that holds a material to be pressed, a module displaceable relative to the die, an electric motor drive acting upon the module during extrusion of the material to be pressed with a force required for extrusion, and a bearing unit having play perpendicular to the force and connecting the electric motor drive to the module, wherein the bearing unit is a cardanic joint and/or comprises a socket that has two degrees of freedom.

2. The extrusion press according to claim 1, wherein the electric motor drive is a direct drive and/or comprises a linear actuator.

3. The extrusion press according to claim 1, further comprising a spindle and a nut axially displaceable with regard to the spindle.

4. The extrusion press according to claim 1, wherein the module is guided by way of at least one moving crossbeam.

5. The extrusion press according to claim 1, wherein the module is an extrusion punch.

* * * * *